US008606522B2

(12) United States Patent
Dinariev et al.

(10) Patent No.: US 8,606,522 B2
(45) **Date of Patent: *Dec. 10, 2013**

(54) METHOD TO DETERMINE CURRENT GAS SATURATION IN A NEAR-WELLBORE ZONE IN A VOLATILE OIL FORMATION

(75) Inventors: Oleg Yurievich Dinariev, Moscow (RU); Alan Sibbit, Moscow (RU); Alexander Nikolaevich Shandrygin, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 275 days.

This patent is subject to a terminal disclaimer.

(21) Appl. No.: 13/121,282

(22) PCT Filed: Sep. 30, 2009

(86) PCT No.: PCT/RU2009/000502

§ 371 (c)(1),
(2), (4) Date: Jul. 25, 2011

(87) PCT Pub. No.: WO2010/039060

PCT Pub. Date: Apr. 8, 2010

(65) Prior Publication Data

US 2011/0276270 A1 Nov. 10, 2011

(30) Foreign Application Priority Data

Sep. 30, 2008 (RU) ..... 2008138641

(51) Int. Cl.
*G01V 1/40* (2006.01)
*G01V 5/10* (2006.01)
*E21B 49/00* (2006.01)

(52) U.S. Cl.
USPC ..... 702/8; 250/269.4; 73/152.06

(58) Field of Classification Search
USPC ..... 702/8, 1–2, 6, 11–14, 22–30, 50, 127, 702/134, 137–138, 188–189; 250/253–258, 250/265–266, 269.1, 269.4–269.5; 73/152.01–152.02, 152.06–152.09, 73/152.11, 152.14, 152.18–152.19, 73/152.22–152.23, 152.27–152.28, 73/152.41–152.42, 152.46, 73/152.51–152.52; 703/5, 9–10, 12
See application file for complete search history.

(56) References Cited

U.S. PATENT DOCUMENTS 5,528,030 A * 6/1996 Mickael ..... 250/269.4
5,909,772 A 6/1999 Merkel et al.
2011/0276271 A1* 11/2011 Dinariev et al. ..... 702/8

FOREIGN PATENT DOCUMENTS

RU 2232409 C1 7/2004

OTHER PUBLICATIONS

Abasov et al., Physical and Mathematical Simulation for Development of Gas-Condensate Fields and Fields of Volatile Oils, May 11-16, 1975, 9th World Petroleum Congress, Tokyo, Japan, 9 pp.*
Kuznetsov, G. S. et al, "Geophysical Control Methods for Oil and Gas Field Development", Moscow, Nedra Publishing House, 1991, pp. 138-139.

* cited by examiner

*Primary Examiner* — Toan Le

(57) ABSTRACT

The invention is related to the development of volatile oil deposits and may be used to determine current gas saturation in a near-wellbore zone in a volatile oil formation. The method for the current gas saturation determination in the near-wellbore zone requires the measurement of the formation rock parameters and formation fluid parameters before the gas accumulation start in the near-wellbore zone and creation of the numerical model of the neutron logging signal change during the production period for the measured formation and formation fluid parameters and expected gas saturation value. During the production period when the well productivity decreases, neutron logging is performed and then the measured signals are matched with the model calculations and based on the provision of the best match of the measured and simulated neutron logging signals gas saturation is determined.

2 Claims, No Drawings

METHOD TO DETERMINE CURRENT GAS SATURATION IN A NEAR-WELLBORE ZONE IN A VOLATILE OIL FORMATION

FIELD OF THE DISCLOSURE

The invention is related to the development of volatile oil deposits' development and may be used to determine current gas saturation in a near-wellbore zone in a volatile oil formation.

BACKGROUND OF THE DISCLOSURE

During the volatile oil deposit development the need to determine a formation gas saturation arises because the wellbores' productivity often decreases due to the gas emission in a near-wellbore zone and partial locking of the oil influx into the wellbore. The invention claimed solves the problem of the determination of current gas saturation value in the near-wellbore zone both for cased and uncased wells.

Until now current gas saturation in a near-wellbore zone could not be determined using geophysical research methods.

SUMMARY OF THE DISCLOSURE

The claimed method of the determination of current gas saturation in a near-wellbore zone in a volatile oil formation comprises the following steps. Formation rock parameters and formation fluid parameters are measured before the gas accumulation in a near-wellbore zone. A numerical model of neutron logging signals change for the measured formation rock parameters and formation fluid parameters and expected gas saturation is created, After the production started and the well productivity decreased a neutron logging is performed and then the measured signals are compared with the model calculations and gas saturation is determined based on the provision of the best matching of the measured and modeled neutron logging signals. Formation rock parameters and formation fluid parameters measured before the well production start include formation porosity, rock mineral composition, water saturation and water composition, reservoir oil PVT-data, including composition and bubble point pressure. The parameters above are determined using traditional logging methods including neutron logging as well as using core and fluid sampling data.

The expected gas saturation is determined by hydrodynamic modeling of the gas-oil mixture for the set formation parameters, formation fluid and phase permeability functions and to provide the best match of the neutron logging measured and modeled signals phase permeability functions are adjusted.

DETAILED DESCRIPTION OF THE PREFERRED EMBODIMENTS

The invention is based on a new approach to the interpretation of the time-lapse neutron logging and enables the determination of current gas-saturation in a near-wellbore zone. At the first stage a volatile oil formation completed by a drilled wellbore is studied using conventional logging equipment as well as by formation tests. The initial gas saturation in the formation will be zero or negligible. These standard measurements will result in a set of characteristic data of the formation rock and formation fluid which includes data of the formation porosity, rock mineral composition, water saturation and water composition, formation oil PVT-data including its composition and bubble point (degassing start point). After that the well will be used as a production well. At this stage if the formation pressure drops below the saturation point gas emission process takes place. It results in the formation of the gas-saturated zone near the wellbore.

After a certain period of the production it is possible to expect significant gas saturation growth around the wellbore. Indirectly it may be observed as productivity factor decrease. At this stage neutron logging may be used to evaluate current gas-saturation in the gas-saturated zone. Any hydrogen-index-sensitive neutron logging method may be applied. The wellbore may be uncased or cased because the neutron flux can pass through steel pipes. The signal observed in itself cannot differentiate between gas saturation and oil saturation because it depends on the saturation, phase density and phase composition (provided that other factors, like rock and water parameters are unchanged). However, the uncertainty of the gas-oil mixture properties may be narrowed down just to the unknown saturation using traditional hydrodynamic composition modeling. In effect, knowing the well production history it is possible to conduct a number of experiments, which differ from each other by phase permeability functions. Numerical experiments will result in a set of theoretical cases of gas-oil mixture parameters significantly different from one another by the saturation values. Using this set of cases it is possible to simulate neutron logging theoretical signals. Comparing them with the measured signal it is possible to determine the actual state of gas-oil mixture near the wellbore. It makes possible the evaluation of the current gas saturation and other properties of the gas-oil mixture.

Using gas-oil mixture hydro-dynamic modeling software (e.g., Eclipse-300) as the output data we obtain the expected gas saturation, gas and oil composition. The input data for the simulation software include the data of the local geological structure (including distribution of the porosity and permeability along the wellbore), formation pressure and temperature data, data of the thermodynamic and physico-chemical properties of the formation fluids resulting from the standard measurements before the start of production, data on the well production history and phase permeability functions. The phase permeability functions may be adopted as a certain current approximation (from the core test date or by analogy with a similar formation).

To evaluate the current near-wellbore gas saturation numerical model of the neutron logging signal during the wellbore operation is used. The model input parameters include the formation porosity and water saturation, water composition, rock mineral composition, formation oil PVT-data including the composition and bubble point as well as the expected gas saturation, oil and gas composition obtained during the hydro-dynamic simulation of the gas-oil mixture parameters.

The current gas saturation is determined by the results of the best approximation of the simulated and measured neutron logging signals. In case of the results divergence the phase permeability functions are corrected to obtain the best approximation of the neutron logging measured and simulated signals. The iteration sequence is stopped when the divergence between the real-life logging signal and simulated signal is negligible. At this moment the next data set is obtained: gas saturation, formation gas and oil composition, phase permeability functions.

What is claimed is:

1. A method for determining current gas saturation in a near-wellbore zone of a wellbore in a volatile oil formation, the method comprising:

measuring formation parameters and formation fluid parameters before starting production, wherein (i) the formation parameters and the formation fluid parameters are measured by at least one of a logging tool, core testing, and fluid testing, and (ii) the formation parameters and the formation fluid parameters are selected from a group consisting of formation porosity, rock mineral composition, water saturation, water composition, formation gas PVT-data, formation gas composition, and bubble point, determining an expected gas saturation value and a composition of a gas-oil mixture in a near wellbore zone by hydro-dynamic modeling the gas-oil mixture using the measured formation parameters, the formation fluid parameters, and phase permeability functions, creating a numerical model to simulate neutron logging signal change during production using the measured formation parameters, the formation fluid parameters, the expected gas saturation value, and the determined gas-oil mixture composition, starting production of the wellbore, performing neutron logging using a neutron logging tool and measuring neutron logging signals after a decrease in well productivity, comparing the measured neutron logging signals with the simulated neutron logging signals, and determining the current gas saturation by adjusting the phase permeability functions until a match is obtained between the measured neutron logging signals and the simulated neutron logging signals.

2. The method of claim 1 wherein the logging tool is a neutron logging tool.

* * * * *